US006692904B2

(12) United States Patent
Fyson et al.

(10) Patent No.: US 6,692,904 B2
(45) Date of Patent: Feb. 17, 2004

(54) PHOTOGRAPHIC WASH SOLUTION AND PROCESS

(75) Inventors: John R. Fyson, Hackney (GB); Jeffrey L. Hall, Rochester, NY (US); Peter J. Twist, Lee Common Great Missenden (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/367,000

(22) Filed: Feb. 14, 2003

(65) Prior Publication Data

US 2003/0148229 A1 Aug. 7, 2003

Related U.S. Application Data

(62) Division of application No. 09/982,463, filed on Oct. 18, 2001.

(30) Foreign Application Priority Data

Nov. 3, 2000 (GB) ..... 0026954

(51) Int. Cl.[7] ..... G03C 5/26; G03C 7/30; G03D 3/04

(52) U.S. Cl. ..... 430/403; 396/625

(58) Field of Search ..... 430/403; 396/625

(56) References Cited

U.S. PATENT DOCUMENTS 5,528,329 A 6/1996 Sawada et al. ..... 396/622
5,910,397 A 6/1999 Feumi-Jantou et al. ..... 430/428
6,505,979 B2 * 1/2003 Twist et al. ..... 396/625

FOREIGN PATENT DOCUMENTS

| | | |
|---|---|---|
| EP | 0 602 446 A1 | 6/1994 |
| EP | 0 872 762 A1 | 10/1998 |
| EP | 0 872 763 A1 | 10/1998 |
| EP | 0 939 337 A1 | 9/1999 |
| EP | 1 111 457 A1 | 6/2001 |

OTHER PUBLICATIONS

JP Abstract 11242312.
JP Abstract 63044654.
JP Abstract 2000292891.

* cited by examiner

*Primary Examiner*—Hoa Van Le

(57) ABSTRACT

A photographic washing bath comprises a chamber containing a wash solution for a silver halide photographic material having a pH of less than 7 and comprising water having dissolved therein an oxidizing agent, said oxidizing agent having an oxidizing potential of at least 1 volt and being in a concentration of from 0.05 to 2 Molar. The oxidation potential of the oxidizing agent is preferably at least 1.2 volts and may be hydrogen peroxide or a source of hydrogen peroxide, a persulphate, a perborate, a bromate, or an iodate. A washing process using the invention is suitable for being carried out in same chamber as the development and fixing stages in which case hydrogen peroxide is the preferred oxidizing agent because any peroxide remaining at the end of the wash stage can be removed by evaporation, thereby avoiding risk of contamination of the next stage to be carried out in the chamber.

11 Claims, 8 Drawing Sheets

PHOTOGRAPHIC WASH SOLUTION AND PROCESS

CROSS-REFERENCE TO RELATED APPLICATION

This is a Divisional of application Ser. No. 09/982,463 filed Oct. 18, 2001.

FIELD OF THE INVENTION

This invention relates to a wash solution for the rapid processing of silver halide photographic materials and to a process in which it is used.

BACKGROUND OF THE INVENTION

After an exposed photographic material has been subjected to the stages of development, bleaching and fixing it is usually also subjected to a washing stage to remove chemicals that affect the image quality from the photographic layer. Previously this washing stage has been carried out by contacting the photographic material with flowing water for sufficient time to allow the chemicals that affect image quality to diffuse through the photographic layer and into the wash solution. These chemicals may come from the previous processing baths or may come from the original photographic material. The chemicals that might emanate from previous processing baths include sulphite and thiosulphate and those from the original material would include silver compounds, the sensitizing dyes that were used to modify the spectral response of the silver compounds and also other coloured dyes added to the photographic layers to modify spectral response and increase image sharpness.

PROBLEM TO BE SOLVED BY THE INVENTION

There is a continuing need to reduce the overall processing time and it is therefore desirable to reduce the duration of any or all of the individual stages of development, bleaching, fixing and washing. Previously the duration of the washing stage could not be reduced without the risk of incomplete removal of the contaminants mentioned above and consequent loss of image quality. The problem is to provide a washing process which will remove these contaminants and be sufficiently fast so that the washing time and hence the overall process time comprising development, bleaching, fixing and washing is reduced. The present invention provides a solution to this problem by employing an oxidizing agent in the wash solution.

SUMMARY OF THE INVENTION

According to the present invention there is provided a photographic washing bath comprising a chamber containing a wash solution for a silver halide photographic material said wash solution having a pH of less than 7 and comprising water having dissolved therein an oxidizing agent having an oxidation potential of at least 1 volt and being in a concentration of from 0.05 to 2 moles per liter.

According to another aspect of the present invention there is provided a photographic washing process which process comprises washing a silver halide photographic material which has been subjected to development, bleaching and fixing, said washing being with an aqueous wash solution as hereinbefore defined.

ADVANTAGEOUS EFFECT OF THE INVENTION

The use of an oxidizing agent in the wash solution enables the duration of the washing stage to be reduced and thereby reduce the duration of the overall process of development, bleaching, fixing and washing.

DETAILED DESCRIPTION OF THE INVENTION

Figure 1:
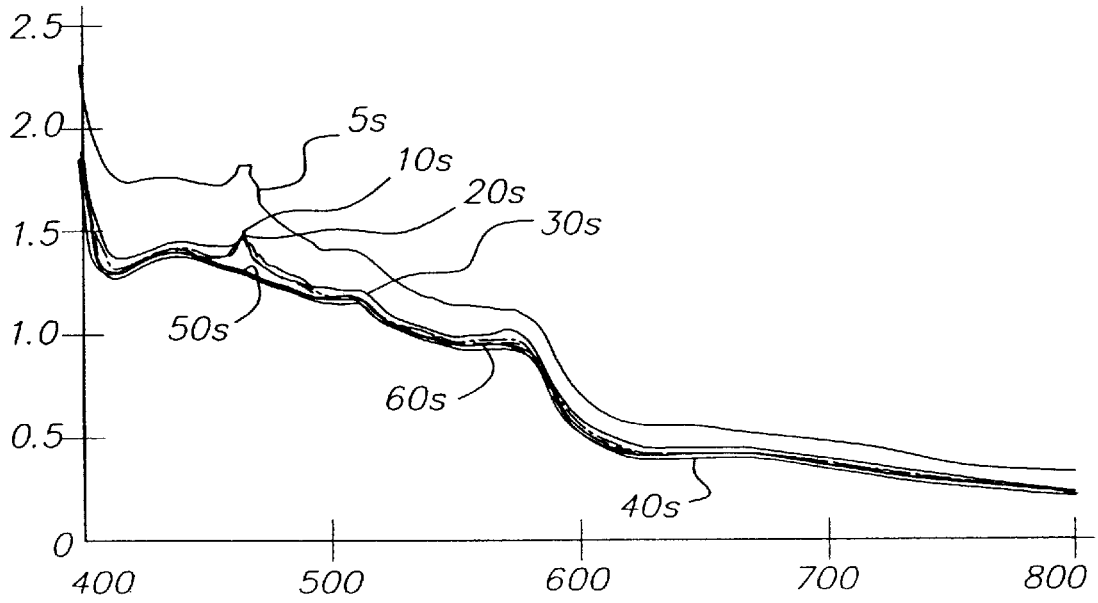
FIGS. 1 to 8 are graphical representations of spectral data obtained from the Examples and Experiments.

The meaning of the term oxidation potential is that given in the handbook of Chemistry and Physics $52^{nd}$ edition 1971–1972 published by The Chemical Rubber Company of Cleveland Ohio U.S.A. References to volts are with respect to a Normal Hydrogen Electrode.

The oxidizing agent should be able to oxidize photographic sensitizing dyes used to modify the spectral response of silver compounds and also chemicals such as thiosulphate and sulphite which remain as contaminants from the fixing stage.

Preferably the oxidizing agent has an oxidation potential of at least 1.2 volts.

The oxidizing agent may conveniently be hydrogen peroxide or a source of hydrogen peroxide, a persulphate, a perborate, a bromate or an iodate.

The concentration of oxidizing agent in the wash solution may be from 0.05 to 2, preferably from 0.2 to 1 more preferably 0.2 to 0.5 moles/liter.

The pH of the wash solution should be less than 7 but otherwise is not critical. It may conveniently be from about 3 to about 6.

The wash solution may optionally contain a wetting agent and a biocide. Hydrogen peroxide is itself a biocide in which case the solution may contain an additional biocide.

Preferably the temperature of the wash solution is not greater than 80 degrees Centigrade and the contact time is from 5 seconds to 2 minutes.

More preferably the temperature of the wash solution is not greater than 70 degrees Centigrade, and is preferably above 15 degrees Centigrade, more preferably above 25 degrees Centigrade. The temperature of the wash solution will typically be in the range 25 to 65 degrees Centigrade.

The washing process may comprise a single washing step or preferably a plurality of washing steps. Where the process comprises a plurality of washing steps the sum of the durations of the steps, including any steps using a conventional wash solution, will be not greater than 2 minutes. Where the process comprises a single washing step the duration will not be less than 5 seconds.

In one embodiment of the photographic washing process prior to washing with the wash solution containing oxidizing agent the photographic material is washed with a conventional wash solution containing no added oxidizing agent.

In one embodiment of the process the wash solution is added by means of a surface application device as described in our copending UK Patent Application No. 9930140.0 filed Dec. 22, 1999 which describes an apparatus for processing light sensitive material, the apparatus comprising at least one movable applicator for applying a fixed volume of processing solution to the surface of the material to be processed, means for moving the applicator and the material relative to each other to enable mixing of the solution on the surface, and means for moving the at least one applicator from a position in contact with the material to a position out of contact with the material such that the process cycle can be varied.

This device does not have a standing tank of wash solution and the volumes of solution applied are similar to the volumes of solution used to replenish standing tanks of wash solution. These volumes are small e.g. 2 to 4 ml/linear foot of 35 mm film and are discarded after the wash stage is complete.

In another embodiment of the process is carried out in a cylindrical drum which is rotated about the axis of the cylinder. A preferred form of this apparatus is a single use wave processor of the type described in our copending UK Patent Application No. 0023091.2, filed on Sept. 20, 2000 which describes an apparatus for processing a photographic material, comprising a chamber adapted to hold the material therein, means for introducing a metered amount of solution into the chamber, means for removing the solution from the chamber, means for rotating the chamber and means for sweeping the surface of the material at each rotation of the chamber, thereby to form a wave in the solution through which the material may pass.

Figure 9B:
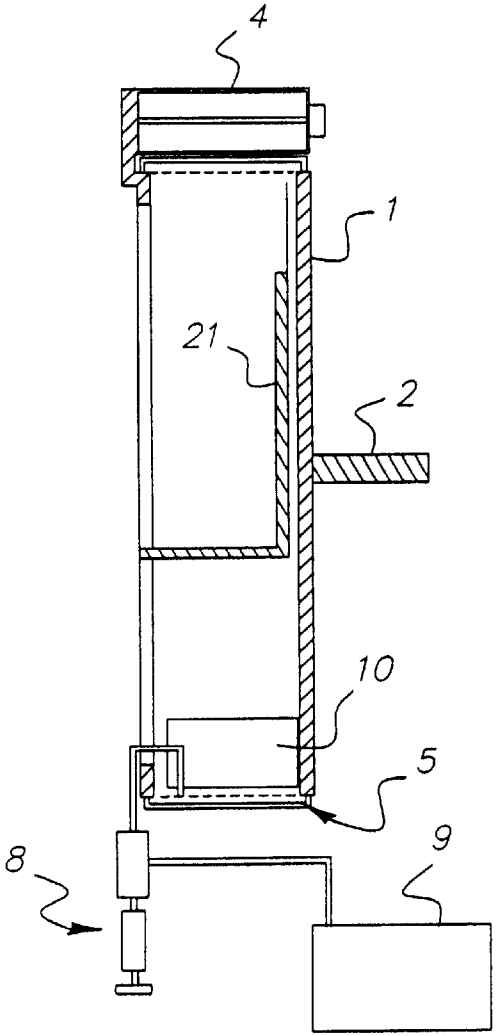
FIGS. 9A and 9B show a schematic side view and section view, respectively, of apparatus in which the method of the present invention can be performed.
Figure 9A:
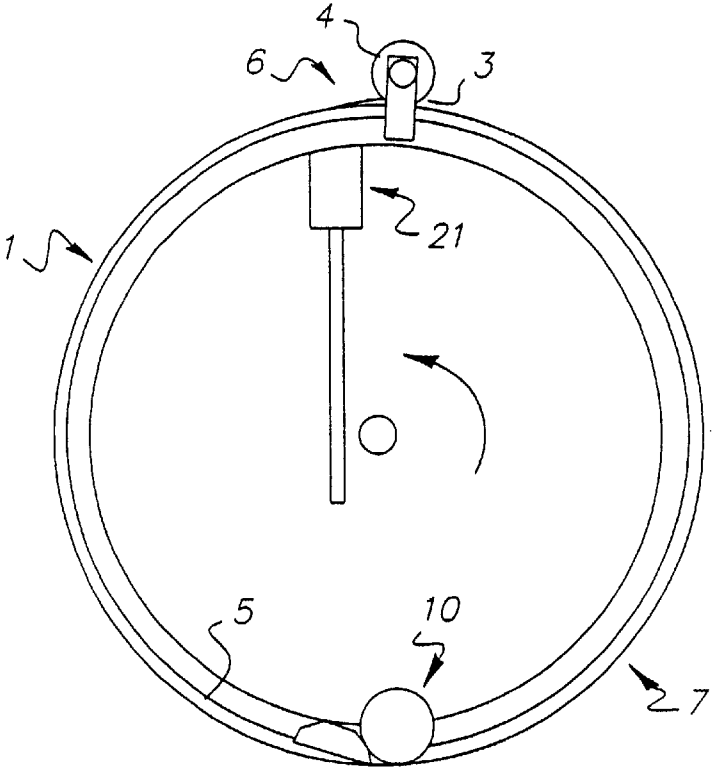

FIGS. 9A and 9B show an embodiment of a wave processor. The wave processor comprises a cylinder 1 having at least one open end. The cylinder may be made of stainless steel, plastics or any other suitable material. A transparent material, such as polycarbonate, may be used if it is desired to scan the material while it is within the cylinder. The cylinder defines a processing chamber. An arm 3 is provided on the outer side of the cylinder for holding a film cassette 4. A slot 6 with a water tight cover (not shown) is provided through the wall of the cylinder to allow the strip of film 5 from the film cassette to enter the processing chamber. The watertight cover may be in the form of a hinged door having a rubber wedge. However, any suitable means may be used. A circular slot is defined around the inner circumference of the chamber for holding the strip of film 5 by the edges.

A second arm 21 is located within the chamber. This arm 21 grabs the tongue of the film and holds it against the inner circumference of the chamber. A close fitting cover (not shown) may be provided around the inner circumference of the chamber which sits above the film surface by at least 0.5 mm. This cover provides at least three functions to improve the performance of the apparatus. Firstly it lowers water evaporation which can cause a temperature drop and can concentrate the processing solution as processing is occurring. Secondly it can itself provide agitation by maintaining a puddle of solution in the gap between the cover and the film surface at the lowest point of the chamber. Thirdly it provides a film retaining means making edge guides unnecessary, although edge guides can be also be provided to prevent the film sticking to the cover. It allows both 35 mm film and APS film (24 mm) to be loaded in the same apparatus and it also allows any length of film to be loaded. The material of the cover can be impervious to processing solution and as such is provided with a break or gap in its circumference so that the two extreme ends of the cover do not meet and through which processing solution is added to the film surface. In this embodiment the cover is fixed and rotates with the chamber as the chamber rotates. In another embodiment the cover is not fixed and rests on rails on each side which allow the cover to slide and remain stationary as the chamber rotates. In this embodiment the cover is again provided with a break or gap in its circumference so that processing solutions can be added to the film surface. In this embodiment a roller can also be provided which sits in the gap in the circumference of the cover and which remains essentially at the lowest point of the chamber. The roller provides additional agitation. In another embodiment the cover can be made of a material which is porous to processing solution such as a mesh material or a material punctured with holes. The cover can be made of plastic, metal, or any suitable material. However, the cover is not an essential feature of the invention.

A drive shaft 2 is provided at the closed end of the cylinder for rotation thereof. The open end of the cylinder 1 is provided with a flange 7. The flange retains solution within the chamber. In the embodiment shown in FIG. 9B the processing solutions are introduced into and removed from the chamber by means of syringes 8. However any suitable means may be used, for example metering pumps. The solutions may be introduced from a reservoir 9. Alternatively the solutions may be held in a cartridge prior to use. The cartridge can consist of part or all the processing solutions required to complete the process and is easily placed or "plugged in" the processor without the need to open or pour solutions. The cartridge can consist of an assembly of containers for each of the solutions required for the process. The solutions may be removed by suction or any other means. Residue of solutions therefore do not build up within the processing chamber. This results in the processing chamber being essentially self cleaning. The cross over times from one solution to another are very short.

It is possible to mount an infra red sensor outside of the chamber. The sensor monitors the silver density of the material during development thereof. However this is not an essential feature of the invention. A wave forming mechanism is provided within the processing chamber. This wave forming mechanism sweeps the film surface and forms a wave of solution, primarily at the lowest point in the chamber. In the embodiment shown in FIGS. 9A and 9B the mechanism is a free standing roller 10. It is possible that this roller may be held on a loose spindle, (not shown), which would allow the roller to be steered and also to be raised and lowered into position. The position of the roller can be changed with this mechanism so that it is to the left or right of bottom dead centre that can be advantageous for the smooth running of the roller. It is also desirable to raise or lower the roller which might facilitate film loading.

In operation a film cassette 4 is located in the arm 3 and held on the outside of the cylinder 1. The end of the film 5 is withdrawn from the cassette and entered into the processing chamber by means of the slot 6. The arm 21 holds the film against the inner circumference of the cylinder and the cylinder 1 is rotated so that the film 5 is unwound from the cassette and loaded into the processing chamber. The film is held in a circular configuration within the processing chamber. This loading is carried out while the processing chamber is dry although it is also possible to load the film if the chamber is wet. The film is held with the emulsion side facing inwards with respect to the chamber. It is also possible to load the film with the emulsion side facing outwards provided a gap is present between the film surface and the inner circumference of the chamber. Once loaded, the film is held by the edges thereof within the circular slot around the circumference of the chamber.

The processing chamber is heated. The chamber can be heated electrically or by hot air. Alternatively the chamber may be heated by passing the lower end thereof through a heated water bath. The chamber is then rotated. When the desired temperature is reached a given volume of a first processing solution is introduced into the chamber. The processing solution may be heated prior to being introduced into the chamber. Alternatively the solution may be unheated or cooled. As the chamber rotates the film is continuously re-wetted with the given volume of solution.

Figure 10:
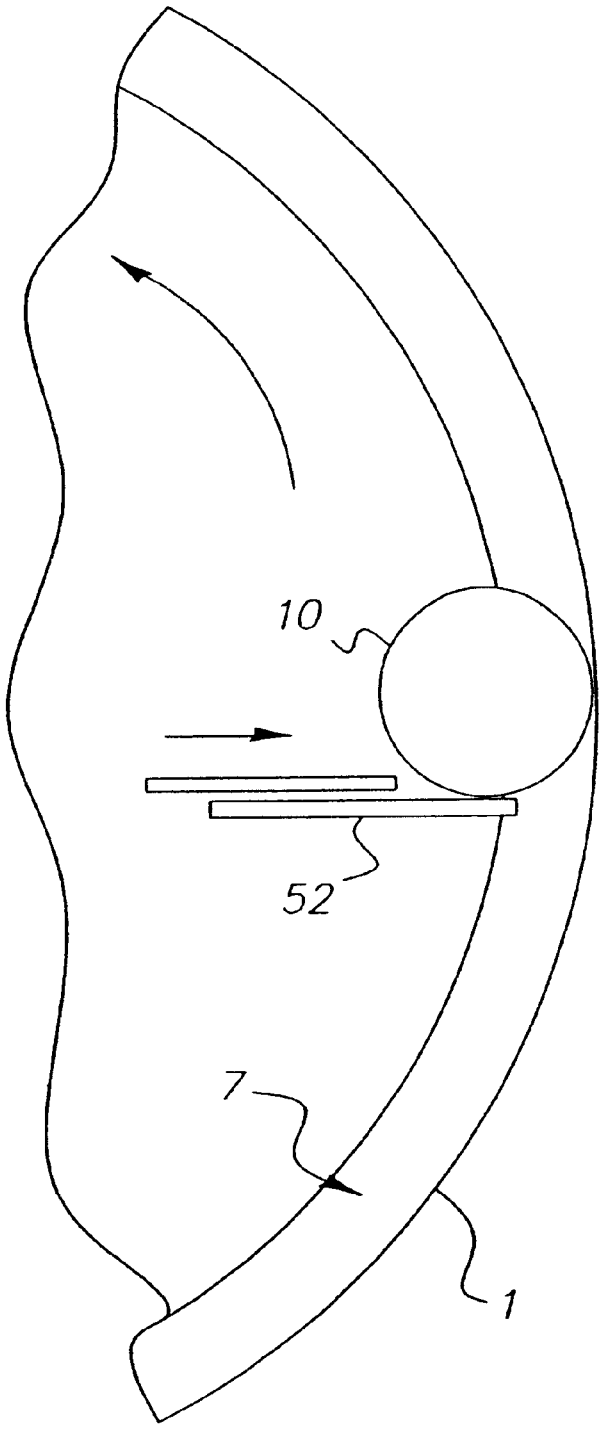
FIG. 10 is an enlarged view of the lower portion of the embodiment shown in FIGS. 9A and 9B.

Processing solution is added onto the roller 10 that is contacted across the whole width thereof by a spreader 52. This can be seen in more detail in FIG. 10. The spreader may be made of flexible soft plastic, rigid plastic or any other suitable material. The roller 10 rotates in contact with the spreader 52. Processing solution is delivered, via a supply pipe, down the spreader to the region of contact between the roller and the spreader. This method forms a uniform bead of solution over the region of contact between the roller and the spreader that extends across the width of the roller 10. This allows uniform spreading of the processing solution onto the film 5 as it passes under the roller 10. It is also possible to add solutions very quickly by "dumping" a given volume into the chamber while it is rotating so that it immediately forms a "puddle" or wave in front of the roller. Yet another method is to add the processing solutions when the chamber is stationary to a region where there is no film or to a region where there is no image such as the fogged end of the film. The rotation of the chamber is then started after the solution has been added. The time interval between adding the solution and starting the rotation can be from zero to any desired hold time.

The roller 10 acts as a wave forming mechanism. This wave forming mechanism, in combination with the rotation of the chamber, provides very high agitation that gives uniform processing even with very active processing solutions. High agitation and mixing are required when only small volumes of solution are being used, in the order of about 0.5 ml. If a large volume of solution is added to the chamber in the absence of a wave forming mechanism a "puddle" of solution is formed and spreading and agitation is achieved. However if a small volume of solution is added to the chamber in the absence of a wave forming mechanism then solution adheres to the film as the chamber rotates. There is no "puddle" formed and there is consequently no agitation or mixing and processing is slow and non-uniform. The agitation and mixing mechanism of the present invention, i.e. the wave forming mechanism, is sufficient to minimise density differences from the front to the back of the film.

The processing solutions i.e. developer, bleach and fix may be added one after the other to the drum which is rotated during each stage. The processing solution of the preceding stage may be removed, conveniently by suction, before the next solution is added. After the wash stage the photographic material, usually film, is removed and the drum dried in preparation for the next photographic material to be processed.

According to a preferred embodiment of the process wherein the development, bleaching and fixing have been carried out in the same chamber the process comprises washing the photographic material in the chamber and repeating the cycle.

According to another embodiment of the photographic washing process where the development, bleaching and fixing have been carried out in the same chamber the process comprises washing the photographic material outside the chamber and adding oxidizing agent to the chamber to oxidize contaminants from the fixing stage. The washing outside the chamber is preferably carried out with a wash solution containing oxidizing agent as described above although it may be carried out with a conventional wash solution containing no added oxidizing agent.

In the processing of a photographic material where a process cycle comprising a plurality of different stages is carried out in the same chamber and the cycle then repeated, it is desirable that contamination of one stage or cycle is not caused by chemicals from a preceding stage or cycle. For example the development stage of one cycle should not be contaminated by chemicals such as sulphite and thiosulphate from the fixing stage of a preceding cycle.

It is an advantage of the present invention that the addition of the oxidizing agent to the wash water has the effect of oxidizing and thereby removing from both the photographic material and from the chamber contaminants such as sulphite and thiosulphate remaining from the fixing stage.

According to a preferred embodiment of the invention the process comprises controlling the amount of oxidizing agent so that not more than 50%, preferably not more than 20% or 10% in excess of the stoichiometrically equivalent amount to the sulphite and thiosulphate is present.

This may be done by calculating the amount of sulphite and thiosulphate remaining from the fixing stage and adjusting the amount of oxidizing agent accordingly.
This has the effect that a significant excess of oxidizing agent does not remain at the end of the wash stage. Oxidizing agent left at the end of the wash stage is a potential contaminant for the first stage (usually the development stage) of the next cycle.

In a further preferred embodiment the oxidizing agent is a compound that is decomposable or rendered inert by heating eg hydrogen peroxide or a compound that yields hydrogen peroxide. This has the advantage that oxidizing agent remaining at the end of the wash stage can be removed from the processing chamber by heating.

According to a further aspect of the invention there are provided photographic materials which have been washed by a process as hereinbefore described.

The invention is illustrated by the following Examples.

EXAMPLES

The following solutions were made up:

Developer

| | |
|---|---|
| water | 500 ml |
| sodium sulfite | 10.5 g |
| sodium bromide | 2.8 g |
| hydroxylamine sulfate | 3.0 g |
| *Anti-Cal #8 (40%) | 6.5 g |
| potassium carbonate | 40.0 g |
| CD-4 | 15.0 g |
| potassium iodide | 2.0 mg |
| **K-15 (PVP) | 3.0 g |
| water to | 1 litre |
| pH adjusted to 10.48 | |

*diethylene triamine penta acetic acid 40% aqueous solution
**polyvinyl pyrrolidone.

Bleach

| | |
|---|---|
| Water | 400 g |
| Succinic acid | 100 g |
| *Anti-Cal #3 | 1.1 g |

-continued

| | |
|---|---|
| PDTA | 137.7 g |
| Ferric nitrate solution (42%) | 236.6 g |
| 0.88 ammonia solution | 120 g |
| ammonium bromide | 114.8 |
| adjust pH to | 4.5 |
| water to | 1 litre |

*2-hydroxy diamino propyl tetraacetic acid.
PDTA is 1,3 propylene diamine tetra acetic acid Fixer

| | |
|---|---|
| water | 500 ml |
| ammonium thiosulfate | 245 g |
| ammonium sulfite | 39 g |
| 1,2,4 triazole-4 thiol | 1 g |
| water to | 1 litre |
| pH adjusted to 6.3 | |

Wash Solutions

| Number | Oxidizing agent | Standard oxidation potential |
|---|---|---|
| 1 | None | |
| 2 | 50 ml/l 30% hydrogen peroxide | 1.5 |
| 3 | 10 g/l sodium persulphate | 2 |
| 4 | 10 g/l potassium perborate | 1.78 |
| 5 | 10 g/l sodium bromate | 1.44 |
| 6 | 4 g/l potassium iodate | 1.2 |
| 7 | 10 g/l potassium perborate<br>10 g/l sodium persulphate | |

The process was carried out with unexposed* 400 speed Kodak (Registered Trade Mark) APS film (agitation with nitrogen burst 0.4 second every 4 seconds)

*Unexposed film was used to avoid image dye formation which might obscure any retained sensitising dye.

| | | |
|---|---|---|
| Develop | 55° C. | 30 s |
| Bleach | 55° C. | 45 s |
| Wash Running water | 45° C. | 60 s |
| Dry | | |

Small pieces of this film were subjected to the following:

| | | | |
|---|---|---|---|
| Re-swell | Running water | 45° C. | 30 s |
| Fix | Bench Mark with fixer as above | 55° C. | 25 s |
| Wash | See table above | 45° C. | 5, 10, 20, 30, 40, 50, 60 s |
| Dry | Hair drier | | |

The abbreviation s stands for seconds.

The strips were then read on a simple spectrophotometer and the following results were obtained The data from the experiments for each wash were treated in the same way. FIG. 1 shows a wash time series for wash 1 (no added oxidizing agent). The loss of dye with a peak at 468 nm was investigated.

Figure 2:
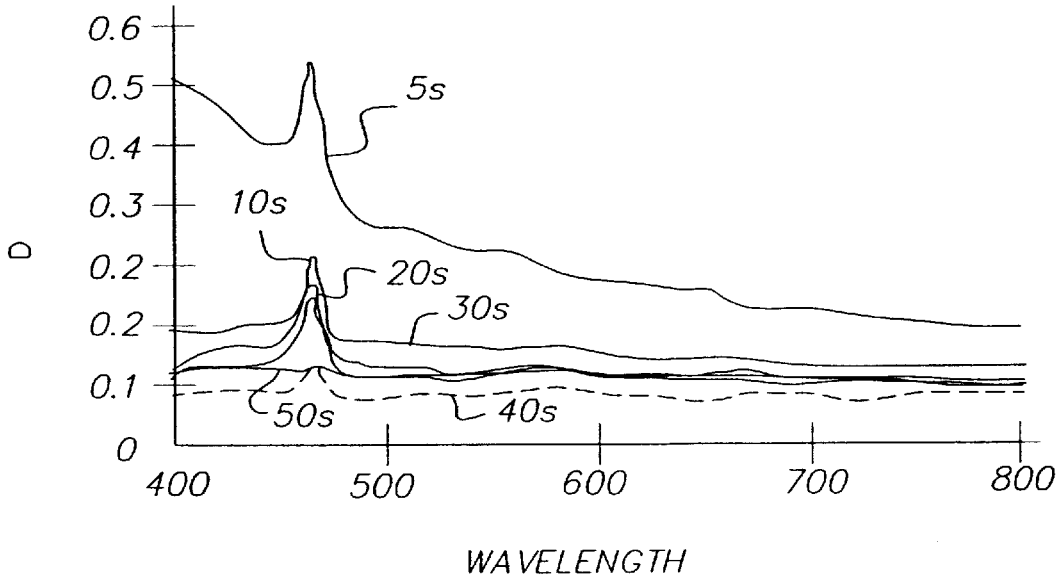

FIG. 2 shows the change in spectra with time by taking spectral data for each time and subtracting the spectrum obtained at 60 s. This shows the peak at 468 nm and its change with time. In order to get around the problem of variation in orientation of the sample in the spectrophotometer, this peak was compared to part of the spectrum with no peak, 540 nm, and the difference obtained. The results for the time of the minimum of these differences were subtracted to get a dye density time curve for the 468 nm peak. This was plotted for all the wash solutions Numbers 1 to 7 and shown in FIG. 3.

Figure 3:
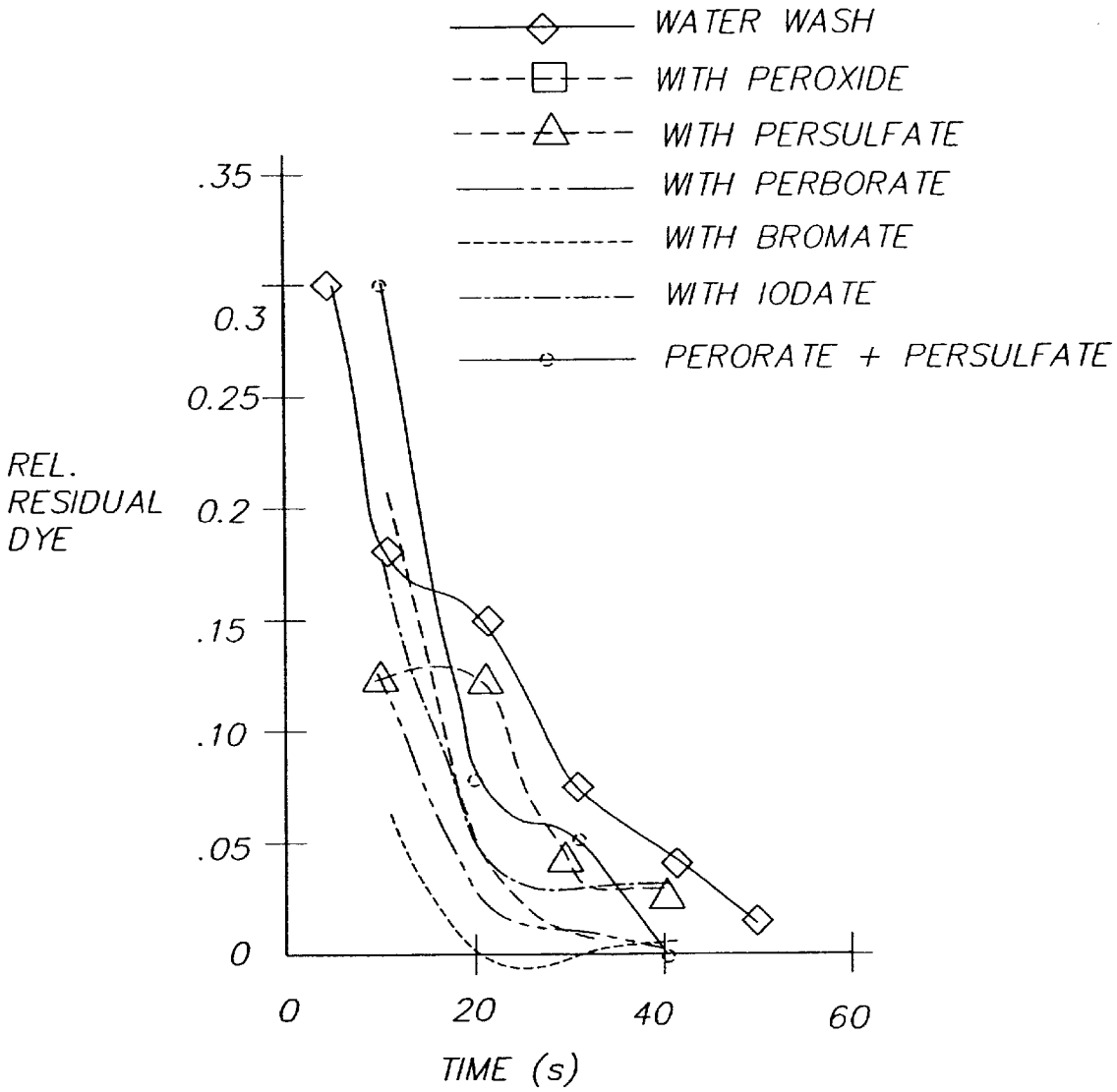

The curves on FIG. 3 show that the addition of the colourless oxidizing agents increased the wash out rate of the dye with a peak at 468 nm.

Other peaks are destroyed by the colourless oxidizing agents to a greater of lesser extent.

Figure 4:
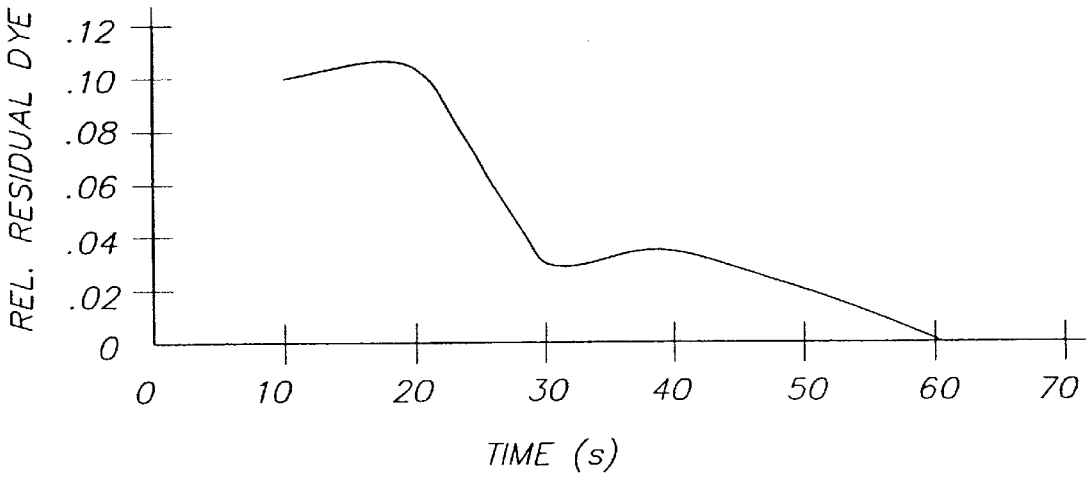

FIG. 4 shows the relative rate of loss of dye with the 510 nm peak with iodate.

Figure 5:
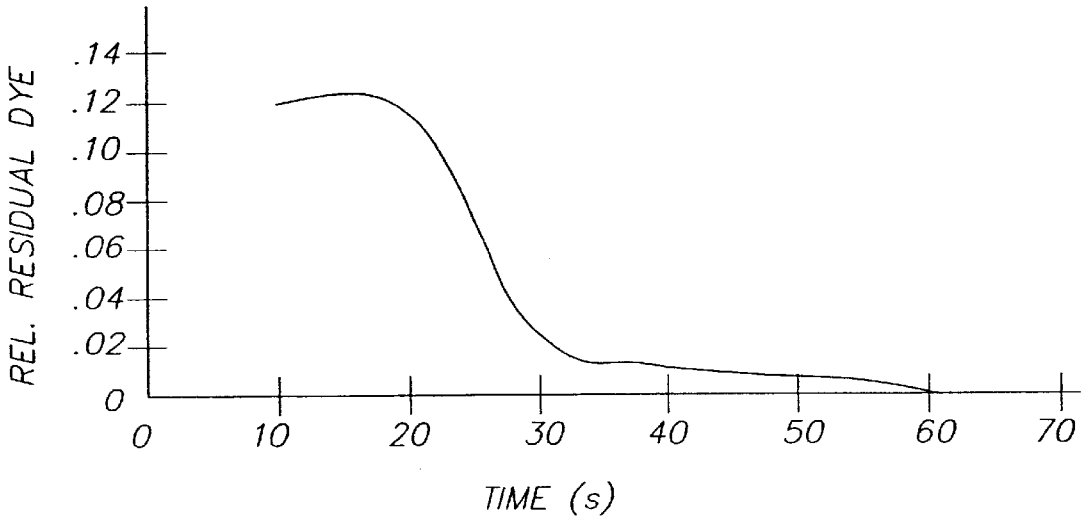

We can see that iodate removes the peaks at 510 nm and 575 nm (FIG. 5).

Experiment A.

In this Experiment all the stages of processing was carried out in a rotating drum chamber using the following process cycle.

TABLE A

| Process cycle. | |
|---|---|
| Development | 30 seconds |
| Stop | 10 seconds |
| Solution removal | 30 seconds |
| Bleach | |
| Solution removal | 45 seconds |
| Fix | |

The film was removed and washed outside the drum and the drum was dried. The next film was processed in the same process cycle.

TABLE B

| Developer composition | |
|---|---|
| Component | concentration |
| $Na_3PO_4.12H_2O$ | 50 g/l |
| DEHA | 5 ml/l |
| KBr | 8 g/l |
| CD4 | 10 g/l |
| Tween 80 | 10 drops/l |
| pH | 11.8 |

DEHA is diethylhydroxylamine, CD4 is 4-amino-3-methyl-N-ethyl-N-(betahydroxyethyl) aniline sulfate, and Tween 80 is a commercially available polyoxyethylene surfactant The bleach was Kodak (Registered Trade Mark) Flexicolor Bleach 111 NR and the fixing agent was Kodak (Registered Trade Mark) Flexicolor C-41b fixer.

Figure 6:
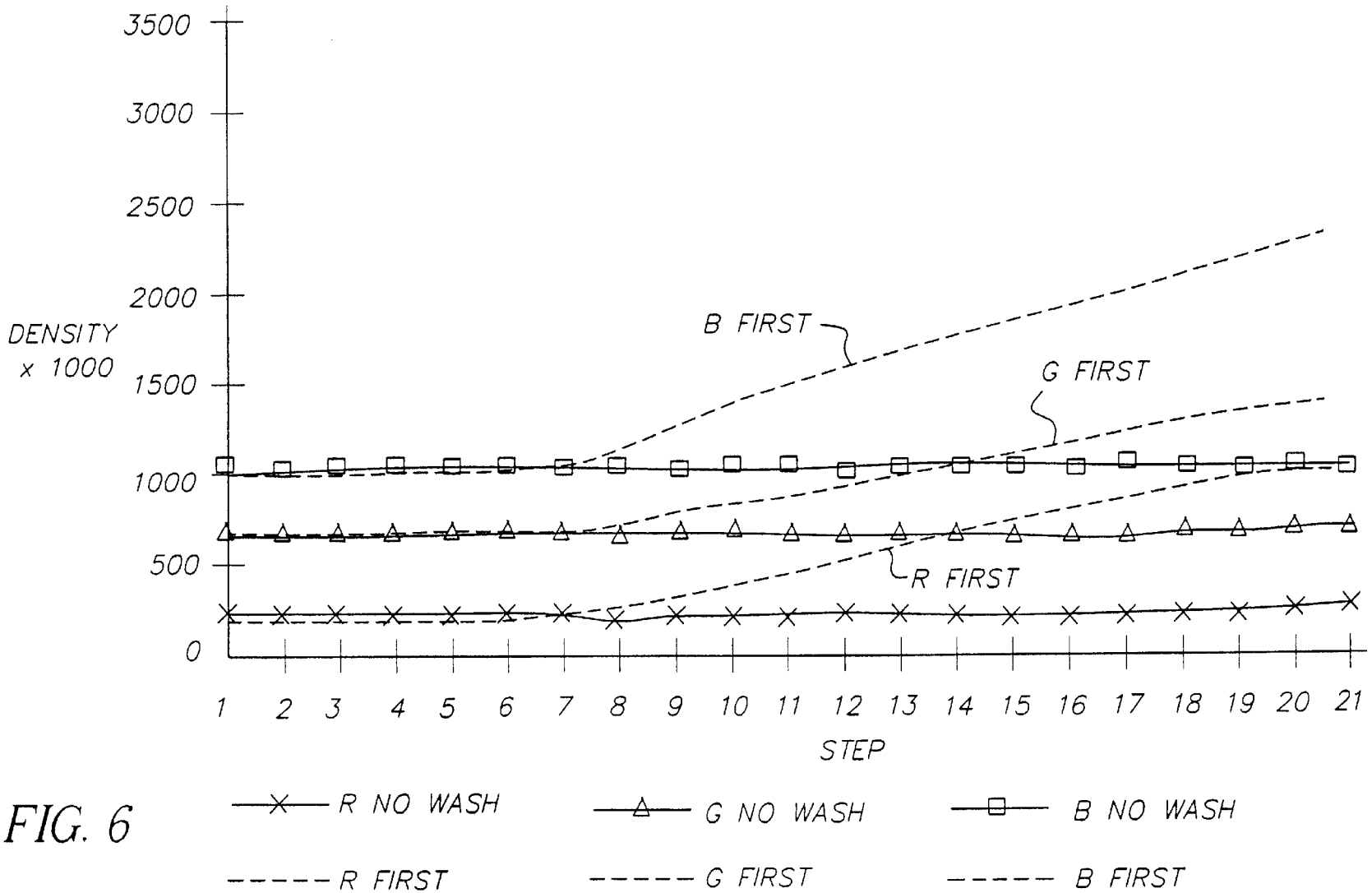

It is noted from Table A that there is no wash stage after the fixer stage and thus the fixer solution is left inside the drum processing chamber (about 1 ml/linear foot of 35 mm film) and is dried down. The next film to be processed is processed satisfactorily as shown in FIG. 6. The dashed lines shown in FIG. 6 are for the first film processed in a clean drum. The solid lines in FIG. 6 are for the second film processed. It can be seen that there is no development at all for the second film. This represents the extreme case where there is no wash stage at all and all the fixer components are dried down in the processing chamber and all these components end up in the developer solution used for the next film.

Experiment B

In this Experiment the process cycle carried out in Experiment A was partly repeated after washing the drum clean of fixer and drying the chamber.

Figure 7:
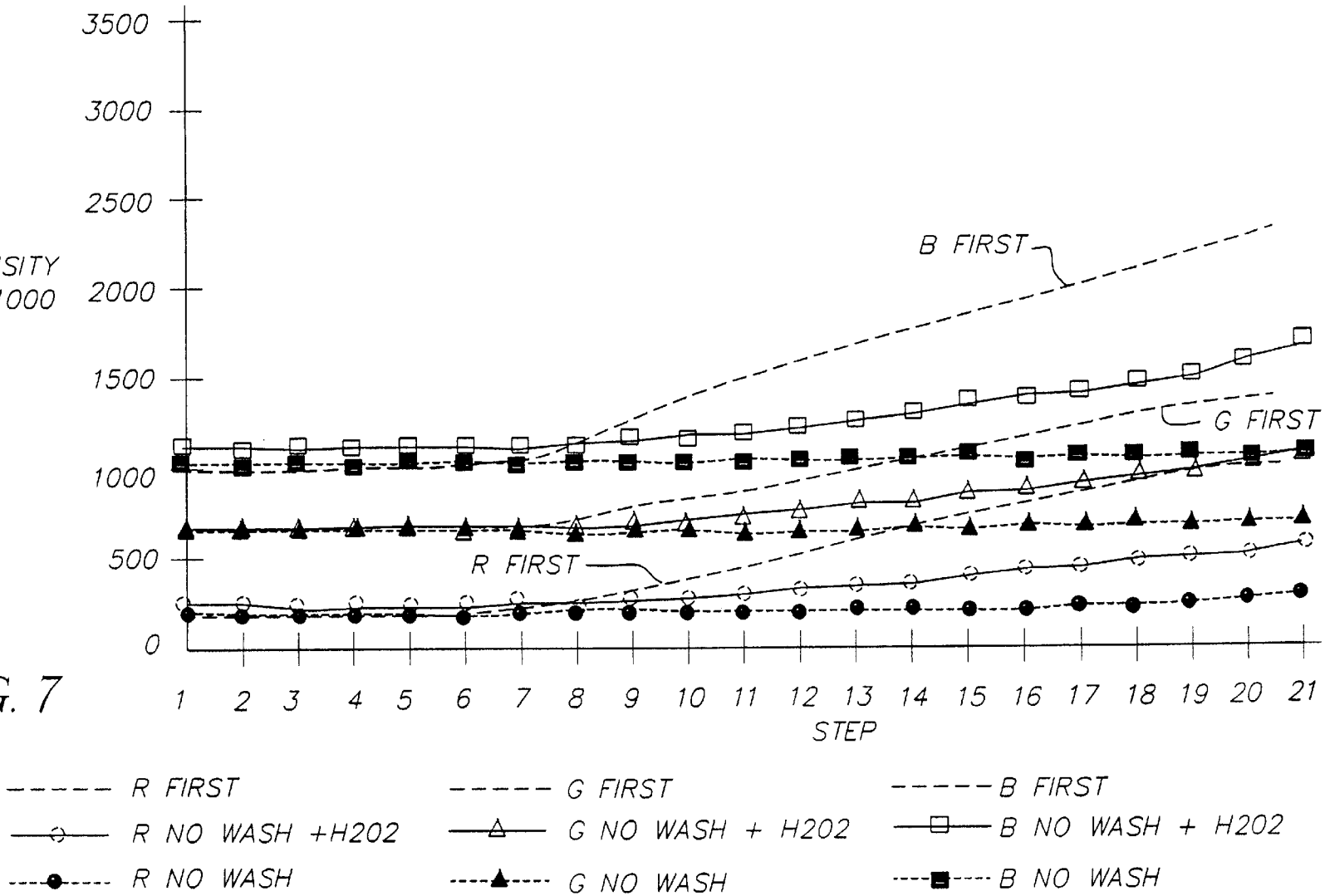

In this Experiment the first film was processed satisfactorily as in Experiment A. This is shown by the dashed curves without points in FIG. 7. In this case the film was removed from the chamber after the fix stage and the film was washed outside the processing chamber. Before the drum was dried hydrogen peroxide solution (30% w/w) was added to the fixer solution in the chamber and left at 60 degrees Centigrade to evaporate to dryness. The next film was then processed with the treated and dried fixer components still in the processing chamber. The solid lines in FIG. 7 show the result when residual fixer is treated with hydrogen peroxide before the next film is processed. It can be seen from FIG. 7 that part of the development is restored after hydrogen peroxide treatment. This demonstrates that sulphite and thiosulphate can be destroyed by the oxidizing agent in the extreme case of contamination when the entire fixer solution is carried over into the developer for the next film.

Experiment C.

In this Experiment the fixer contamination is at a lower level which is more consistent with what might be found in practice. In this case a single water wash at a rate of 4 ml/linear foot of 35 mm film was carried out and the wash water removed from the processing chamber. A residual fixer concentration of ⅕ of that where there is no wash was left in the chamber. A film (one wash) was processed without removing the residual fixer that mixes with the developer solution. The same procedure was repeated except that after the wash 1 ml/l of hydrogen peroxide (30% w/w) was added to the chamber that was then dried down at 60 degrees Centigrade. Another film (one wash plus peroxide) was then processed in the chamber. The results are shown in FIG. 8 where first is a strip processed in a clean drum chamber, 1 wash is another strip processed after only 1 wash of a previous strip which leaves residual fixer in the chamber and (1 wash plus peroxide) in which another strip is processed after only 1 wash of the previous strip but with hydrogen peroxide added to the residual fixer and evaporated.

Figure 8:
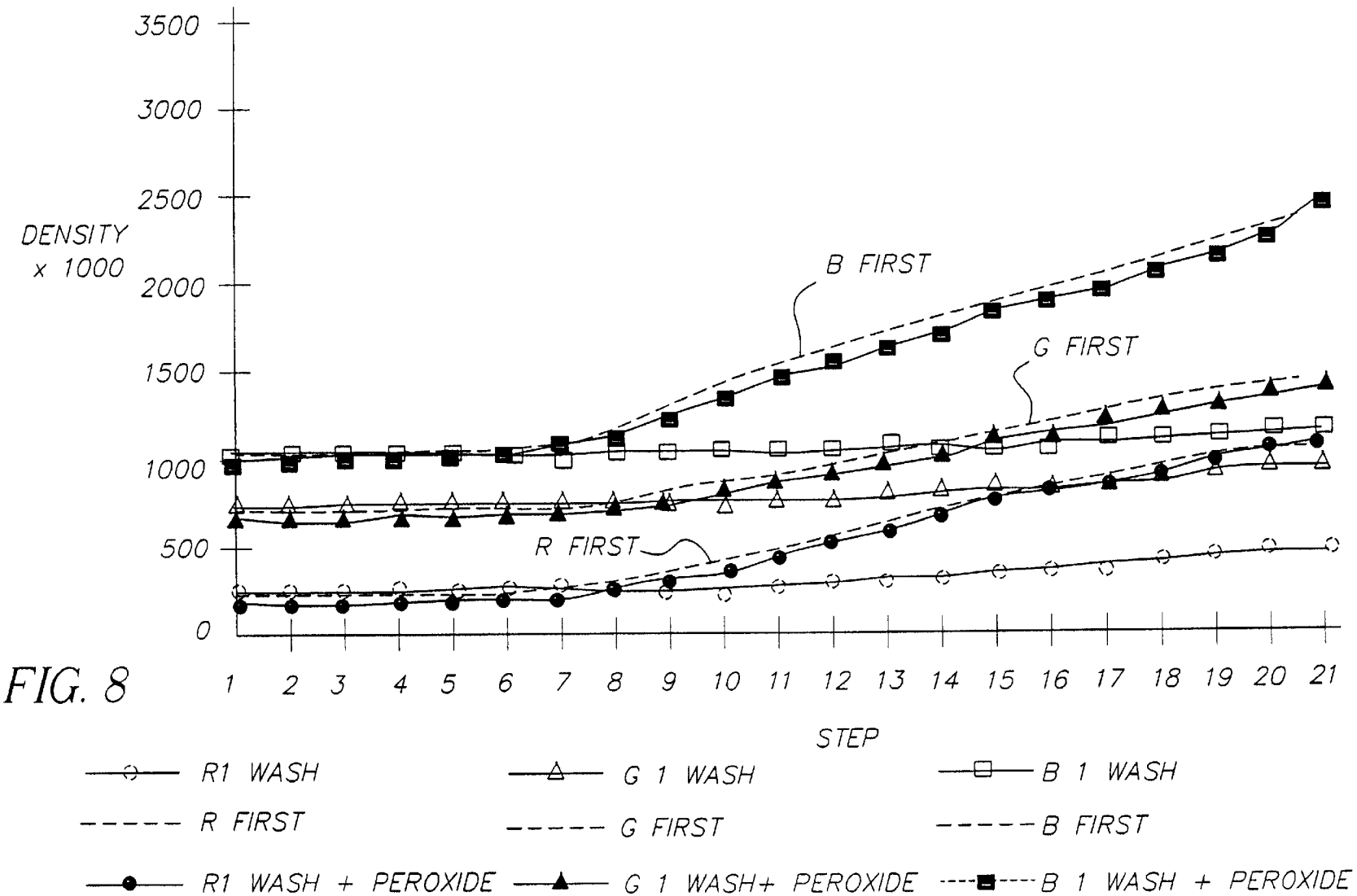

It can be seen from FIG. 8 that development is completely inhibited by the residual fixer left after only one wash of the previous strip. Development is completely restored with the peroxide treatment.

What is claimed is:

1. A photographic processor comprising a processing chamber, the chamber being adapted to execute at least two processing steps of silver halide photographic material, one of the at least two steps being washing of the silver halide photographic material, the chamber being further adapted to receive a wash solution for the silver halide photographic material said wash solution having a pH of less than 7 and comprising water having dissolved therein an oxidizing agent, said oxidizing agent having an oxidizing potential of at least 1 volt and being in a concentration of from 0.05 to 2 Molar.

2. The photographic processor as claimed in claim 1 wherein the oxidation potential of the oxidizing agent is at least 1.2 volts.

3. The photographic processor as claimed in claim 1 wherein the oxidizing agent is hydrogen peroxide or a compound that yields hydrogen peroxide, a persulphate, a perborate, a bromate, or an iodate.

4. The photographic processor as claimed in claim 1 wherein the concentration of oxidizing agent is from 0.2 to 1 moles per liter.

5. A photographic washing process comprising washing a silver halide photographic material that has been subjected to the stages of development, bleaching and fixing, said washing being carried out in a photographic processor as claimed in claim 1 and where the temperature of the wash solution is not greater than 80° C. and the contact time is from 5 seconds to 2 minutes.

6. The photographic washing process of claim 5 wherein the temperature of the wash solution is from 25 to 65° C.

7. The photographic washing process of claim 5 wherein prior to washing with said wash solution containing oxidizing agent, said photographic material is washed with a conventional wash solution containing no added oxidizing agent.

8. The photographic washing process of claim 6 that comprises controlling the amount of oxidising agent present in said wash solution so that there is not more than 50%, preferably not more than 20% in excess of the stoichiometric amount equivalent to the sulphite and thiosulphate remaining in the chamber from the fixing stage.

9. The photographic washing process of claim 5 wherein the amount of oxidizing agent present is at least stoichiometrically equivalent to the sulphite and thiosulphate remaining in the chamber from the fixing stage and wherein the oxidizing agent is decomposable by heating or rendered inert by heating whereby oxidizing agent remaining in the chamber at the end of the wash stage may be eliminated by heating.

10. The photographic washing process of claim 5 wherein the development, bleaching and fixing have been carried out in the same chamber and which comprises washing the photographic material in the chamber and repeating the cycle.

11. The photographic washing process of claim 10 that comprises a heating step to remove the oxidizing agent remaining at the end of the washing stage.

* * * * *